US005113820A

United States Patent [19]

Flaig

[11] Patent Number: 5,113,820

[45] Date of Patent: May 19, 1992

[54] METHOD OF AVOIDING EXCESSIVE ENGINE DRAG TORQUE

[75] Inventor: Ulrich Flaig, Markgroningen, Fed. Rep. of Germany

[73] Assignee: Robert Bosch GmbH, Stuttgart, Fed. Rep. of Germany

[21] Appl. No.: 573,028

[22] PCT Filed: Feb. 2, 1989

[86] PCT No.: PCT/EP89/00090

§ 371 Date: Aug. 28, 1990

§ 102(e) Date: Aug. 28, 1990

[87] PCT Pub. No.: WO89/08776

PCT Pub. Date: Sep. 21, 1989

[30] Foreign Application Priority Data

Mar. 16, 1988 [DE] Fed. Rep. of Germany ..... 3808692

[51] Int. Cl.[5] ..... F02D 41/12

[52] U.S. Cl. ..... 123/325; 123/493

[58] Field of Search ..... 123/325, 492, 493

[56] References Cited

U.S. PATENT DOCUMENTS 4,204,483 5/1980 Harada et al. ..... 123/493
4,245,599 1/1981 Des Lauriers ..... 123/353
4,311,123 1/1982 Glöckler et al. ..... 123/493
4,457,276 7/1984 Ueda et al. ..... 123/339
4,700,673 10/1987 Denz ..... 123/325
4,777,918 10/1988 Yasuoka ..... 123/340

FOREIGN PATENT DOCUMENTS 0240409 10/1987 European Pat. Off. .
0143135 8/1983 Japan .

*Primary Examiner*—Tony M. Argenbright
*Attorney, Agent, or Firm*—Felfe & Lynch

[57] ABSTRACT

The disclosure describes a method of avoiding an excessive drag torque for motor vehicles. When the accelerator pedal is released, an amount of fuel is supplied to the engine which is approximately under zero-load and which is gradually reduced over time. The occurring change of the rotational speed is monitored. When a certain rotational speed change is exceeded per time unit, the amount of fuel is gradually increased over time until a certain positive rotational speed change is recognized. Then, there is a switch-back to reducing the amount of fuel. The procedure is repeated until the vehicle has reached an operational condition with a constant rotational speed.

8 Claims, 1 Drawing Sheet

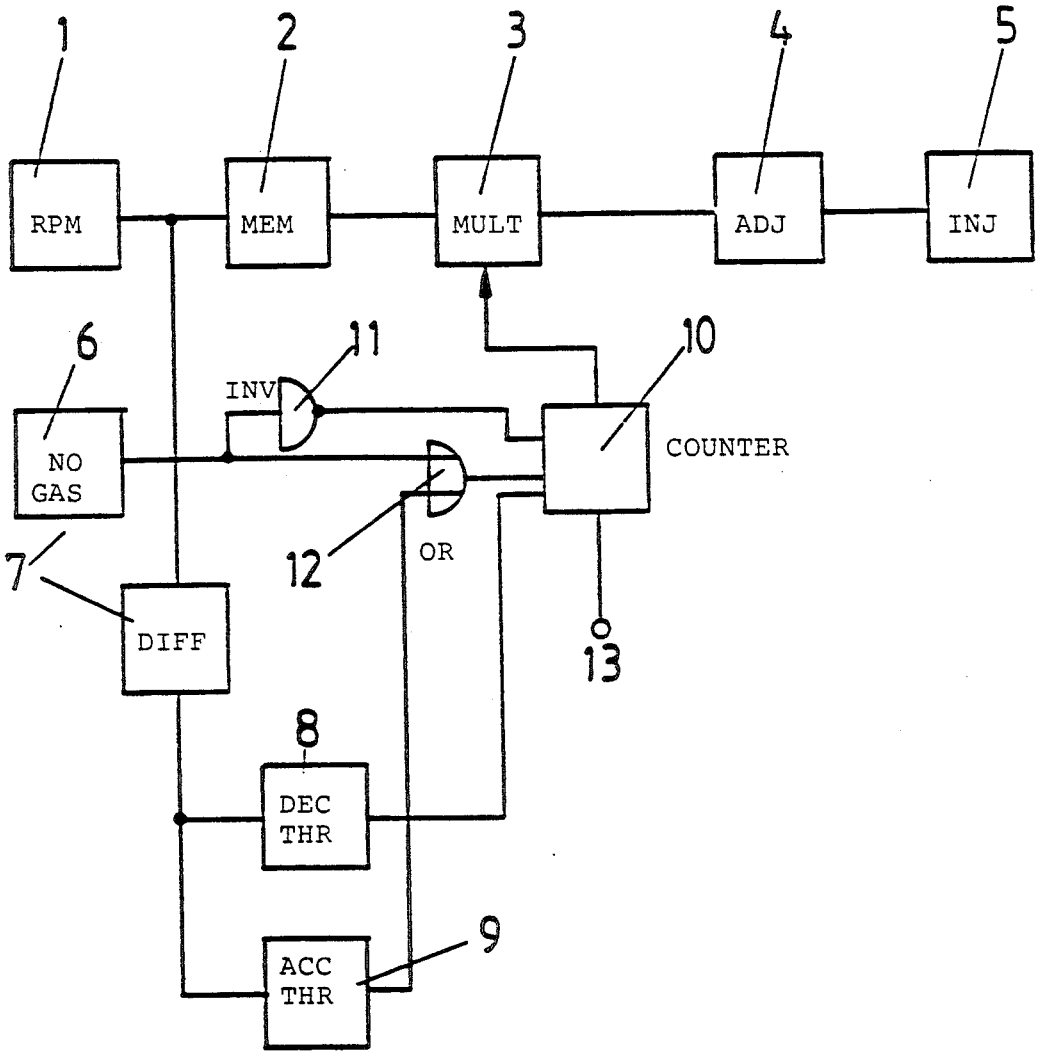
1
2
3
4
5
RPM
MEM
MULT
ADJ
INJ
6
11
10
INV
NO GAS
COUNTER
12
OR
7
DIFF
13
8
DEC THR
9
ACC THR

METHOD OF AVOIDING EXCESSIVE ENGINE DRAG TORQUE

BACKGROUND OF THE INVENTION

The invention relates to a method of avoiding an excessive engine drag torque in motor vehicles by controlling the amount of fuel supplied to the engine after release of the accelerator pedal.

A device is known from German OS 21 39 230 where the fuel supply to the engine is increased when the speed of the driven wheels is too slow with respect to the vehicle speed when the brakes are not applied. This is to avoid too great a slippage of the driven vehicle wheels and instability of the vehicle.

SUMMARY OF THE INVENTION

The invention addresses the task of limiting the braking torque occurring when the accelerator pedal is released to a value which prevents a permanent locking of the driven wheels.

This is accomplished by making the residual amount of fuel time-dependent in addition to being dependent on the engine speed. After release of the accelerator, the fuel supply is gradually decreased until it reaches zero, or until the wheels have begun to lock. In the latter case the fuel supply is then increased until a prescribed acceleration has been reached, after which it may subsequently be decreased again.

As compared to the simple adjustment of the fuel amount which corresponds to approximately the zero-load amount, the proposed method has the advantage that on roads with a sufficiently high friction coefficient, the fuel amount is reduced down to zero, i.e. the advantages of fuel cut-off are retained.

BRIEF DESCRIPTION OF THE DRAWING

The FIGURE is a block diagram of an embodiment of the invention.

DETAILED DESCRIPTION OF THE PREFERRED EMBODIMENT

In the FIGURE engine rotational speed sensor 1 is connected to a characteristic line memory 2 for the initial values, including a prescribed residual amount of fuel to be injected in dependency upon the rotational speed, which memory 2 in turn is connected to a multiplier 3. An adjusting device 4 for an element 5 varying the fuel supply may be the control rod of the injecting pump, while element 5 is the injection pump itself. A non-represented accelerator pedal acts on these elements. Sensor 6 is a sensor for the condition "acclerator pedal in zero-load position" or a no-gas switch. The speed signal of sensor 1 is supplied to a differentiator 7.

Downstream of the differentiator 7, two threshold value switches 8 and 9 are connected in parallel. Threshold value 8 responds when the reduction of the engine speed and, hence, the deceleration, is so great that a tendency to lock the wheels is recognized. The threshold value switch 9 responds when a certain acceleration of the driven wheels is exceeded.

A forward/backward counter 10 provides a correction factor which, in multiplier 3, is connected to the output of characteristic line memory 2. The scaling is selected such that the highest count represents a multiplication of one.

The counter 10 has inputs to "set to maximal count" and to count up and down. The count frequency which is supplied at a terminal 13 can, for example, be selected by a prescaler, independent of counting up or down. Moreover, the inputs are to have triggered flanks.

An inverter 11 and an OR-gate 12 are connected between sensor 6 and counter 10. If a sensor 6 signals that the accelerator pedal was released, a signal which depends on the instantaneous rotational speed and represents the residual amount to be injeted is fed to the multiplier 3. Triggered by sensor 6, the correction from counter 10 is at this moment available at the second input of multiplier 3. Immediately after the release of the acclerator pedal and thus the control rod 4 of the injection pump, a position is set which permits selecting the exact residual amount of fuel to be injected. This residual amount to be injected, which depends upon the the rotational speed, is selected such that under practically all operational conditions, the drag torque does not reach an unacceptably high vlaue. When the drag troque is too high, the drive wheels can lock leading to the loss of driving stability.

Since the residual amount to be injected is selected so as to be rather high for regular conditions, the advantages of today's conventional fuel cut-off are lost. In accordance with the invention, the residual amount is made time-dependent in addition to being dependent upon the rotational speed. The correction factor defined in the forward/backward counter 10 serves this purpose.

Immediately after recognizing the condition "accelerator pedal released " by block 6, the correction factor starts at unity and begins a ramp-like decrease over time, thus causing the drag torque to increase. The correction value is decreased until either a value 0 is reached or the braking power associated with the drag torque leads to a very fast decrease of the engine speed because the frctional adhesion of the tire-road system has been reached. In the latter case, the signal of the differentiator 7 becomes greater than the threshold value of the threshold value switch 8. The positive flank of the output signal of the threshold value switch 8 switches the direction of forward/backward counter 10 and, optionally, the counting frequency thereof. This is carried out until the threshold value switch 9 recognizes a positive rotational speed change of a certain magnitude. The positive flank of the signal of the threshold value switch 9 switches the counter 10 back to count down. The procedure can be repeated until the vehichle reaches an operational condition with a constant engine speed. This is usually the idling speed of the engine.

I claim:

1. Method of controlling the residual amount of fuel supplied to an engine after release of the accelerator pedal such that there is no unacceptably high drag torque under any operational conditions, wherein the rotational speed of the engine is monitored for reaching a prescribed deceleration and a prescribed acceleration, and where when the prescribed deceleration is reached, a time ramp increasing the residual amount is activated and when reaching the prescribed acceleration, a time ramp decreasing the residual amount is activated.

2. Method in accordance with claim 1, characterized in that the residual amount which depends upon the rotational speed is additionally dependent upon at least one of the operational engine parameters of temperature, speed, and selected gear.

3. Method in accordance with claim 1, characterized in that the time ramp for increase and the time ramp for decrease can be independently selected.

4. Method in accordance with claim 1, characterized in that the residual amount is changed by controlling a correction factor.

5. Method in acordance with claim 4, characterized in that the correction factor value can be selected between 0 and 1.

6. Method in accordance with claim 4, characterized in that the correction factor is determined by a numerical value of a forward/backward counter, supplied with a counting pulse.

7. Method in accordance ith claim 5, characterized in that the correction factor is determined by a numerical value of a forward/backward counter, supplied with a counting pulse.

8. Method for controlling the fuel supplied to an engine after release of the accelerator pedal, comprising decreasing the amount of fuel supplied to the engine according to a time ramp following release of the accelerator pedal, monitoring the engine speed and the time rate of change of the engine speed, increasing the amount of fuel supplied to the engine according to a time ramp when said engine reaches a prescribed deceleration during release of said pedal, thereby causing said engine to accelerate, and decreasing the amount of fuel supplied to the engine according to a time ramp when said engine reaches a prescribed acceleration during release of said pedal.

* * * * *